United States Patent [19]

Müller

[11] Patent Number: 4,596,583

[45] Date of Patent: Jun. 24, 1986

[54] PROCESS FOR DYEING LOW-FLAMMABLE LINEAR POLYESTER FIBER TEXTILE MATERIAL

[75] Inventor: Siegfried Müller, Kelkheim, Fed. Rep. of Germany

[73] Assignee: Hoechst Aktiengesellschaft, Fed. Rep. of Germany

[21] Appl. No.: 550,741

[22] Filed: Nov. 10, 1983

[51] Int. Cl.[4] ..... D06P 1/38; D06P 3/54; D06P 5/02

[52] U.S. Cl. ..... 8/543; 8/532; 8/533; 8/549; 8/922

[58] Field of Search ..... 8/539, 543, 693, 694; 528/287

[56] References Cited

U.S. PATENT DOCUMENTS

| | | | |
|---|---|---|---|
| 3,052,653 | 9/1962 | Iannicelli | 8/539 |
| 3,386,990 | 6/1968 | Dale et al. | 8/543 |
| 3,412,070 | 11/1968 | Jakob et al. | 528/287 |
| 3,458,537 | 7/1969 | Johnson | 8/694 |
| 3,864,315 | 2/1975 | Ohno et al. | 8/539 |
| 3,941,752 | 3/1976 | Kleiner et al. | 528/287 |
| 3,954,396 | 5/1976 | Ribka et al. | 8/693 |
| 3,962,194 | 6/1976 | Bollert et al. | 528/287 |
| 4,014,647 | 3/1977 | Neeff | 8/694 |
| 4,035,343 | 7/1977 | Bollert et al. | 528/287 |
| 4,049,633 | 9/1977 | Penton | 8/539 |
| 4,056,356 | 11/1977 | Gilkey et al. | 8/539 |
| 4,076,783 | 2/1978 | Yasuda et al. | 8/539 |
| 4,097,229 | 6/1978 | Koller et al. | 8/543 |
| 4,115,056 | 9/1978 | Koller et al. | 8/543 |

FOREIGN PATENT DOCUMENTS 896041 5/1962 United Kingdom .

OTHER PUBLICATIONS

Muller et al., *Chemiefasern/Textilindustrie* 30:38–45 (1980).

*Primary Examiner*—A. Lionel Clingman
*Assistant Examiner*—John F. McNally
*Attorney, Agent, or Firm*—Connolly and Hutz

[57] ABSTRACT

Poor wet fastness properties and unsatisfactory fastness to thermofixing of dyeings on flame-retardant PES fibers with conventional disperse dyestuffs preclude the deployment of textile material of this type in the industrial wear and contract business, such as for utilitarian textiles, sportswear or the like. The reduced boil-wash stability of such disperse dyestuffs on the modified fibers can lead to washing problems because of the risk of bleeding.

Using disperse dyestuffs which contain highly polarized groupings in the molecule for dyeing flame-retardant PES fibers substantially improves the dyeing results in respect of the fastness properties sought and hence opens up further areas of use for said types of fiber. The flame-resistant properties of the textile material are not impaired.

4 Claims, No Drawings

PROCESS FOR DYEING LOW-FLAMMABLE LINEAR POLYESTER FIBER TEXTILE MATERIAL

The present invention relates to a process for dyeing, with water-insoluble disperse dyestuffs, fiber material which consists of or contains low-flammable linear phthalic acid esters with co-condensed phosphorus-containing chain members.

German Pat. No. 2,346,787 describes the production of low-flammable textile material from linear phthalic acid ester fibers with cocondensed phosphorus-containing chain members. The same reference also already reveals how these fibers can be dyed with disperse dyestuffs and with acid dyestuffs. Although flame-retardant fibers of said generic type cannot be referred to as carrierfree-dyeing, they can be dyed at the boil in the absence of carrier to a medium depth of shade in a good color yield. Commercially available disperse dyestuffs—as is apparent from the journal Chemiefasern/Textilindustrie 30/82 (1980), pages 38–45—may very likely even produce very deep shades, but it has been found that the wet fastness properties, in particular the boil-wash stability, of these dyeings are so poor that textile material consisting of fibers dyed in this way are out of the question for use for utilitarian articles or for workwear. According to the promotional literature from HOECHST AG, this modified type of fiber can also be used for producing bed linen; however, to produce colored bed linen by means of conventional disperse dyestuffs has so far not been possible. These areas of application make good wash fastness properties absolutely necessary.

It is then the purpose of the present invention to remedy the abovementioned deficiencies which arise in the dyeing of flame-resistant polyester fibers and to obtain satisfactorily fast dyeings on textile material exclusively made of such fibers or on the corresponding component of fiber blends using commercially customary dyeing processes. This should considerably broaden the application sector for these types of fiber.

This object is achieved according to the invention by using, as colorants, disperse dyestuffs which contain in the molecule at least one highly polarized grouping bonded to an aromatic nucleus of the chromophore and fixing these dyestuffs on the fiber from an aqueous dispersion at pH 5–10 by means of heat.

The advantages which are realized as a result of these measures are good boil-wash and sublimation fastness properties of these dyeings, even in deep shades. The dyeings even have good to very good light fastness properties. The wash fastness properties in the 60° C. wash, which were formerly inadequate, can now be called very good. The fiber material can from now on be used in the industrial wear and contract business, i.e. for any type of utilitarian textiles. Nor is it any longer out of the question to use it as linen (for example bed linen for infirmaries and nursing homes). These fibers can now even be used in blend with cellulose fibers, which was not possible before since even in a blend with low-flammable cellulose fibers the fastness properties required for the dyeings were not reached. Finally, the field of application for certain modified polyester fibers is broadened and the fire safety thereby increased.

This result was surprising insofar as the use of disperse dyestuffs having highly polarized groupings in dyeings on normal PES fibers yields no benefit whatsoever in terms of dyeing properties compared with those using conventional disperse dyestuffs. By contrast, the disperse dyestuffs containing highly polarized groupings have been found to be advantageous in the dyeing of modified fibers which, in certain regions of the structure, have loosened molecular segments.

Suitable dyestuffs for the dyeing process according to the invention are all water-insoluble disperse dyestuffs which, in a finely divided state, are otherwise also suitable for dyeing synthetic fiber material, provided they have in the present case a highly polarized grouping. Most of the representatives of this class of dyestuff are structurally azo, anthroquinone, nitro or quinophthalone compounds, are predominantly carboxyl- and/or sulfo-free and without exception carry in the molecule at least one highly polarized grouping bonded to an aromatic nucleus of the chromophore. Said highly polarized grouping in the disperse dyestuffs used in mainly a radical based on a side chain having an $—SO_2—$ or —CO— bridge member. This primarily means the vinyl sulfone radical. Satisfactory results are, furthermore, also obtained with disperse dyestuffs which are substituted by the acrylic acid radical or a dialkyl($C_1$–$C_4$-)aminosulfone radical. The disperse dyestuffs which can be used according to the invention can contain several highly polarized groupings of said type, which may be of differing nature, on the same dyestuff molecule.

The dyestuffs, as is customary for disperse dyestuffs, are dispersed and are then added to the dyebath in the customary manner. The dyeing is generally carried out at pH 5–10. It is known from experience that the best color yields are obtained at pH 7–9.

Suitable fiber material for the textile goods dyed in the present dyeing process is low-flammable linear phthalic acid esters with cocondensed phosphorus-containing chain members based on carboxyphosphinic acids, as described in German Pat. No. 2,346,787. Natural components of blends with said modified polyester fibers are in the main cellulose fibers or even wool fibers.

With this fiber material it is of no importance whether the dyeing is performed using a padding process or the exhaust method. If the dyeing is carried out at the boil, carrier, as is generally customary, is added to the liquor; in the case of HT dyeings the temperature used should not be higher than 120° C. because otherwise the fiber material might suffer a loss in strength. In the case of Thermosol methods or padding methods with subsequent Thermosoling, temperatures above 190° C. should be avoided, although it is immaterial whether the dyestuff is fixed by means of dry heat in the form of hot air or superheated steam, contact heat or IR radiation.

The following examples serve to illustrate the invention. The percentages given therein are by weight and are based in the case of the liquor pick-up data on the weight of the dry goods.

EXAMPLE 1

A fabric which consists of low-flammable linear phthalic acid ester fibers with cocondensed phosphorus-containing chain members is wound with straight edges onto a perforated dyeing beam (thickness of the wound layer of fabric about 30% of the beam diameter) and is treated at 120° C. in an HT beam dyeing apparatus for 45 minutes with an aqueous liquor which circulates in one direction, namely from in to out, and which contains 1.2% of the disperse dyestuff of the formula

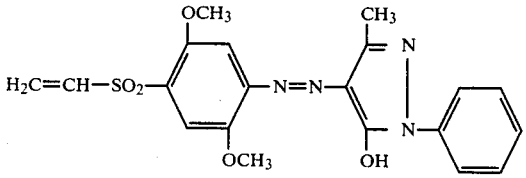

in the form of a finely divided dispersion and per liter 1 g of a naphthalenesulfonate condensed with formaldehyde, as a dispersant, and which has been brought to pH 7–8.

When the dyeing process is finished the fabric thus dyed is first rinsed with water and is then finished by soaping at the boil for 20 minutes in a neutral aqueous bath. The fiber material is obtained with a golden yellow shade of excellent light, boil-wash and thermofixing fastness properties.

EXAMPLE 2

A plain weave fabric (160 g/m$^2$) which consists of low-flammable linear phthalic acid ester fibers with cocondensed phosphorus-containing chain members is padded at room temperature on a pad-mangle to a pick-up of about 60% of an aqueous dyeing liqur which contains per liter 30 g of the disperse dyestuff of the formula

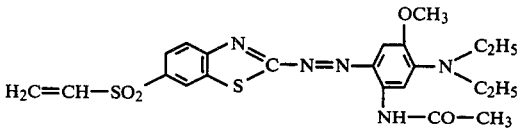

in a finely dispersed form and has been brought to about pH 8, and is then dried at 130° C. To fix the dyestuff on the fiber the padded fabric is then subjected to dry heat at 190° C. for 60 seconds and is then soaped at the boil in a neutral aqueous bath.

The pigeon gray resulting on the treated textile material is distinguished by an excellent boil-wash fastness.

In performing the above pad-dyeing it is immaterial whether the post-rinse is carried out continuously or discontinuously. Also, a commercially available wetting agent can be added to the padding liquor if the nature of the fabric requires it without adverse effect.

EXAMPLE 3

A velvet weave which consists of low-flammable linear phthalic acid ester fibers with cocondensed phosphorus-containing chain members is treated at the boil in a sealed reel beck for 60 minutes with an aqueous liquor which contains 1% of the disperse dyestuff of the formula

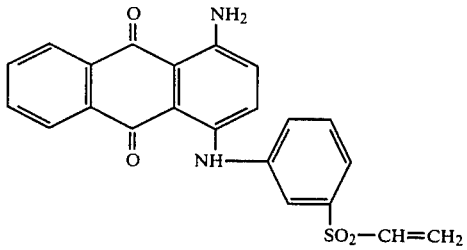

in a conventionally dispersed state and 4% of a carrier emulsion based on 60% methylnaphthalene and which has been brought to a virtually neutral pH.

The fabric dyed in this way by exhaustion is at the end of the dyeing, rinsed hot with water and is then subjected to a neutral boil wash in an aqueous medium for 20 minutes. The carrier used is removed again from the fabric by a subsequent hot-air treatment of the dyeing at 150° C. for 3 minutes. A blue dyeing having very good wash and thermofixing fastness properties is obtained on the textile material.

I claim:

1. In a process for dyeing, with water-insoluble disperse dyestuffs, fiber material which contains low-flammable linear phthalic acid esters with co-condensed phosphorus-containing chain members, the improvement which comprises:

using, as a colorant at least one disperse dyestuff which is free of COOH or $SO_3H$ groups or both and which contains in the molecule one or a plurality of groupings exhibiting polar character, each said polar grouping being a vinyl sulfone, dialkylaminosulfone or acrylic acid radical bonded to an aromatic nucleus of the chromophore; in the case of a plurality of said polar groupings, said polar groupings being the same or different; and fixing the dyestuff on the fiber from an aqueous dispersion at pH 5–10 by means of heat.

2. The process as claimed in claim 1, wherein several said polar groupings are present on the same molecule in the disperse dyestuff.

3. The process as claimed in claim 1, wherein the dyeing is carried out at pH 7–9.

4. A process for the dyeing, with water-insoluble disperse dyestuffs, fiber material, said process comprising:

coloring, with a said disperse dyestuff, fiber material containing low-flammable linear phthalic acid esters with co-condensed phosphorus-containing chain members; said disperse dyestuff containing in the dyestuff molecule a chromophore having an aromatic nucleus and at least one vinyl sulfone, dialkylaminosulfone, or acrylic acid radical, or a combination of said radicals, bonded to a said aromatic nucleus; and fixing said disperse dyestuff on said fiber material from an aqueous dispersion at pH 5–10 by means of heat.

* * * * *